United States Patent [19]

Ringe

[11] 4,415,294

[45] Nov. 15, 1983

[54] SUPPORT MEANS AND SYSTEM FOR SUPPORTING MINE ROOFS

[76] Inventor: Thomas Ringe, P.O. Box 303, Phoenixville, Pa. 19460

[21] Appl. No.: 294,735

[22] Filed: Aug. 20, 1981

[51] Int. Cl.[3] ..... E21D 21/00

[52] U.S. Cl. ..... 405/259; 411/78

[58] Field of Search ..... 405/259, 260, 261; 411/77-80; 72/339

[56] References Cited

U.S. PATENT DOCUMENTS 3,216,306 11/1965 Taylor ..... 411/78
3,301,123 1/1967 Worley ..... 405/259 X

FOREIGN PATENT DOCUMENTS 1183462 12/1964 Fed. Rep. of Germany ..... 405/259
440772 1/1936 United Kingdom ..... 411/80

*Primary Examiner*—Dennis L. Taylor
*Attorney, Agent, or Firm*—Eugene E. Renz, Jr.

[57] ABSTRACT

Support means and system for supporting mine roofs, and particularly those areas of mine roofs between ribs of pillars in coal mines. Coal mine roofs frequently consist, at least in part, of shale in overlying strata, and are notoriously weak in tensile and shear strength. Heretofore, mine roof bolts for strengthening installation systems have been known. Bolts of different types, and different installation systems and patterns have been used. Various drawbacks have existed.

The present invention teaches a roof bolt manufacture, and an improved installation use system and pattern. The bolts include a pair of coactive elongated steel members. One member is of a general U-shaped configuration and has edges of a generally undulating or stepped wavilinear configuration, with the formed apex portions slightly inturned. The coactive slide member, formed from a partial round bar is shaped to a generally serpentine shape, again of a generally stepped wavilinear configuration broadly similar to the body edges, and having a straight section at one end. The members are operatively intermeshed in use, with the slide being rectilinearly movable with respect to the body member. Intercoaction of the stepped wavilinear configurations creates a lateral separation and force. The slide is punched inwardly proximate the ends to form inner protrusions adapted to be contained between the body edges and prevent respective lateral slippage upon rectilinear movement between the members. The members, upon insertion in a hole in a mine roof, and actuation thereof, create pressures in the material of the mine roof with reinforcement thereof.

10 Claims, 12 Drawing Figures

30
L1
L2
32
20
26
44
22
28
D
D
24
3.
60
58
62
68
74
5.
78
26
64
66
62
68
72
70
74
86

SUPPORT MEANS AND SYSTEM FOR SUPPORTING MINE ROOFS

TECHNICAL FIELD

The present invention relates generally to underground mining and more especially to support of overhead ceilings or roofs in the underground passageways of mines. It is well known and recognized that mine roofs, especially those of coal mines, tend to have structural weakness due to the composition of overlying strata which frequently includes shale which is notoriously weak in tensile and shear strengths.

Numerous failures and collapses of mine roofs of this type have heretofore seriously jeopardized the lives of men working in undergound mines. The solution to the problem of providing safe and adequate roof support is a very serious one and has been long-standing.

An ancient type of roof support in mines utilized timbers and similar supports members including masonry walls and arches, steel timber sets, metal props, steel and masonry supports and others. Such installations are not only comparatively expensive due to material support costs but are increasingly costly due to installation costs, including labor. Such previously used support means have also been found in many instances to be inefficient and cave-ins have resulted.

More recent developments in the area of mine roof support means and systems have used elongated roof bolts which are inserted into openings drilled in the strata above the roof of mine passageways at predetermined spaced-apart intervals. One type heretofore used included anchor-like fastening means at one end adjacent the uppermost part of a hole and means at the opposite end of the bolt to place the bolt under tension. While it was believed that use of this arrangement would result in compressive forces vertically and simulate a thicker and stronger overhead strata, this type of bolt in use was not completely satisfactory. Compression of strata vertically while at least partially compensating for tension component of shear, did not adequately compensate for the compression component. Other drawback results of this type of anchor were found in use, including installation where soft strata areas tended to create anchor slippage, tending to cause support failure, and anchor slippage frequently resulted in complete failure of roof support.

Other types such as block wedges were heretobefore used but again failed to completely and satisfactorily maintain safe mine roof supports and were unsuitable for reuse.

A still further type was an expansion bolt incorporating an internally threaded wedging plug. This type was not only complicated in structure but in usage. This type provided relatively small contact areas with the walls of roof holes and, particularly when used in soft strata materials, there was a slippage tendency which led to roof failure.

Many other types have heretobefore been utilized. The most successful types of anchor bolts and mine roof support systems heretobefore used and known are of the types shown in U.S. Pat. Nos. 3,301,123, issued Jan. 31, 1967 and 3,496,754, issued Feb. 24, 1970, both of which are assigned to a common assignee with the present application. Each of these prior patents and the apparatus and devices taught therein provided mine roof bolts broadly comprised of a pair of elongated members of coacting stepped configurations in the nature of undulating or curvilinearly waved surfaces, the two members being, in an assembled and nested relationship inserted into pre-drilled holes in mine roofs and subsequent rectilinear relative movements of the two members engaged the side walls of the holes and created forces within the overlying strata which resulted in strong resistance to strata movement, which is the major cause of roof failure, and for the most part was highly satisfactory as a system and support means for supporting mine roofs.

While these prior known and used roof bolt structures disclosed in the prior patents have proven quite successful, it has been found that, especially in one form thereof, some drawbacks do exist and which can result in precluding entirely satisfactory results in use.

The present invention is primarily directed to providing mine roof support means and system of installation which overcomes the drawbacks of the prior known art.

BACKGROUND OF THE INVENTION

A high percentage of mines have a shale roof weak in tensile and shear strengths. Known types of roof bolts and support means, including expansion-shell and resin bolts do not work well in this type of material. Resultant failure and roof falls can be extensive, expensive and dangerous to miners. Attempts have been made to utilize composite or plural bolting systems simultaneously such as, for example, expansion-shell or resin bolts with a truss system to combat the problem but difficulties are still encountered.

The tendency of a mine roof to sag between the ribs of the pillars after the coal has been mined is principally a shearing action. Shear has a tension component and a compression component. These two components must be supported or a mine roof will tend to fall. Some rock, such as limestone and sandstone, usually have sufficient tensile and shear strength to support the roof without additional support. Where shale exists in the overlying strata, however, and which is typically weak in tensile and shear strength, heretofore known and used roof supporting systems are not only tested severely but frequently have failed. It is known that shale constitutes a large percentage, for example up to approximately 50%, of roofs immediately above coal seams.

Known and heretofore used installations have not accommodated the various forces which occur or exist in mine roofs and will not accommodate both the shear within the beam and the compression component.

While the mine roof bolts taught in the above-mentioned U.S. patents have, for the most part, proven to be very satisfactory in use, an area for improvement was noted in one particular form of roof bolt especially.

Basically, the present invention improves the form of roof bolt disclosed in the embodiments shown in FIG. 10 to FIG. 16, inclusive, in each of the above patents. This form of the disclosed invention comprised two members, one of which was constituted by a bar member of generally U-shaped cross-section having longitudinal spaced-apart side edges with a stepped edged configuration defining a plurality of angularly disposed, longitudinally spaced flat cam surfaces. The edges generally are of an undulating or stepped wavilinear configuration, and a coactive solid slide member was formed to a generally serpentine shape having an inner surface or face of a stepped configuration comparable generally to the stepped wavilinear configuration or undulation of the edges of the U-shaped member.

In use, the two members in a stacked or nested configuration were inserted into a pre-drilled hole or opening in the roof strata and then axially or linearly displaced, one with respect to the other, into an expanded position wherein the opposing outer surfaces of the members were displaced laterally into pressure-applying relation with the side wall of the opening in the roof strata.

The prior patents not only disclose this type of structure but additionally teach a method of manufacture of the same. It has been found in actual practice that this configuration is not only less expensive to manufacture; it is comparatively light to facilitate handling in the mines; utilizes less material and additionally has proven highly satisfactory when installed.

This prior type of construction in use was capable of easy and quick installation and easily removable after a period of time for reuse. These roof bolts firmly gripped the strata of the roof essentially throughout their length and effectively eliminated anchor slippage and minimized harmful effects of bolt elongation. Roof bolts of this type, in use, pre-stressed the strata or layers of materials above the roof laterally and the prior patents referred generally to a use pattern or arrangement to support compression and tension components of shear stress in the roof layers.

The present invention while directed to a similar construction as described above and as disclosed in the prior patents, incorporates improvements thereover not only in construction, but in individual functional operation of separate roof bolts, and a system for pattern of bolt use resulting in improved roof support.

SUMMARY OF THE INVENTION

The present invention, accordingly, is broadly directed to mine roof bolts of an improved nature and to a mine roof support system utilizing a predisposed pattern of such bolts, the overall result constituting a substantial improvement in the art as will appear hereinafter.

More specifically, the present invention discloses a particular improvement in that type of roof bolt which includes the generally hollow or open faced U-shaped member and coactive solid bar, with the interacting undulating or stepped wavilinear edge configurations which cooperated or coacted to create the expanding or lateral force system necessary for adequate and appropriate mine roof support.

As will appear hereinafter the individual mine roof bolts include means to prevent lateral movement or slippage between the two members. This is accomplished by providing interior projections or protrusions on the solid member which are confined, operatively, within the edges of the generally U-shaped member and which are guidedly constrained as the two members are rectilinearly or axially moved with respect to one another to create the lateral forces as described. Lateral slippage between such members, i.e. the FIGS. 10–16 embodiments shown in the prior patents, can result in failure of appropriate efficient action of the roof bolts. Such lateral slippage would tend to cause or result in possible disengagement between the camming surfaces which provide the lateral expansion and lateral forces. As noted and explained in the prior patents, there is relatively small movement between the two members comprising an individual mine bolt, i.e., a single land or step, and it is within this small movement that lateral slippage or displacement must be prevented. Use of this configuration, as pointed out in the previous patents, and hereinbefore, is highly desirable due to the cost factors and high degree of satisfaction in installation and use.

A method of manufacture of the particular bolts of the present application is generally set forth and will be appreciated as constituting an improved concept in this regard.

The present invention and application additionally discloses a method or system to support mine roofs between the ribs of pillars of a known nature, by providing a lateral force system which supports the compression component of shear. At the same time the lateral force system type of bolts, by contacting the rock over the length of a pre-prepared hole, bonds the rock layers together vertically for supporting the tension component of shear. To this end the invention discloses a particular pattern arrangement and use of the individual mine bolts, with highly improved resultant overall roof support.

Still other objects and advantages of the present invention will become readily apparent to those skilled in the art from the following detailed description, wherein there is shown and described preferred embodiments of the invention, simply by way of illustration of a preferred mode presently contemplated for carrying out the invention. As will be realized, the invention is capable of other and specifically different embodiments, and its several details are capable of modifications in various, obvious respects, all without departing from the invention. Accordingly, the drawings and description are to be regarded merely as illustrative in nature, and not as restrictive.

BRIEF DESCRIPTION OF THE DRAWING

The accompanying drawings illustrate a preferred embodiment of the invention and, when taken together with the description, serves to explain the principals of the invention.

DETAILED DESCRIPTION OF PREFERRED EMBODIMENTS

Figures 1, 2, 3, 4:
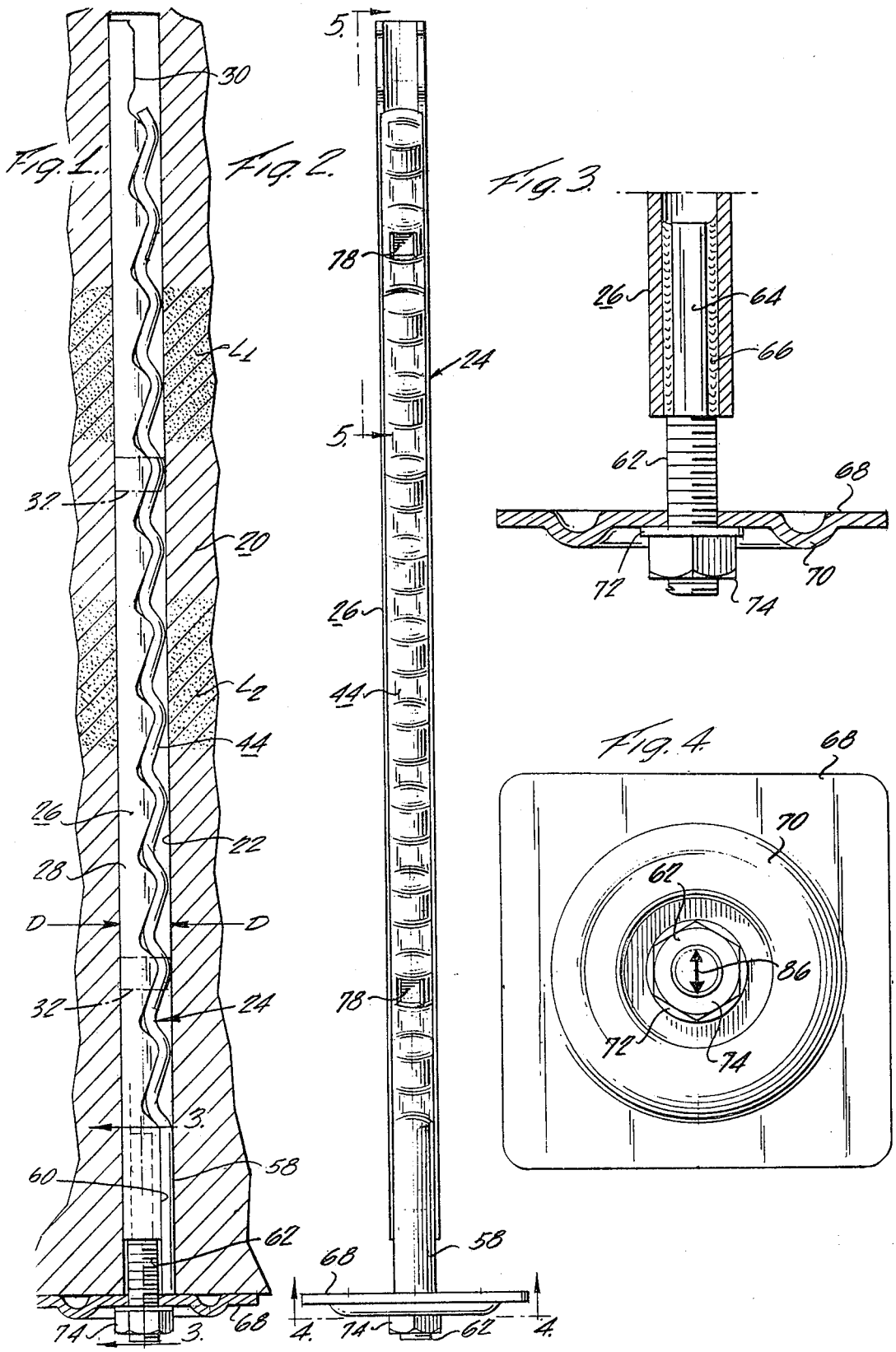
FIG. 1 shows a section of mine roof strata with a bolt operatively positioned in a hole therein, the bolt being in accordance with the present invention.
FIG. 2 is an elevational view of the bolt disclosed in FIG. 1 taken at right angles to the showing of FIG. 1.
FIG. 3 is a fragmentary sectional view taken along line 3—3 of FIG. 1 and disclosing actuating means for the bolt.
FIG. 4 is a bottom plan view of the bolt and operating structure taken along line 4—4 of FIG. 2.

Referring now in detail to the drawings, and particularly FIG. 1, there is shown a portion of a mine roof generally designated 20 and consisting of a plurality of layers of different materials, the layers being designated $L_1$, $L_2$, etc. and specifically defining different materials such as shale, sandstone, lime, and the like as normally present in mine roof strata.

In accordance with the teachings of the invention a hole or opening 22 is drilled vertically upwardly into the material of the mine roof strata and is generally circular and of a diameter indicated by arrows at D. The size of the opening is just sufficient to easily insert therein a mine bolt, generally designated 24, in accordance with the teachings of the invention. A particular set of dimensions will be hereinafter set forth for one workable embodiment of the invention.

The basic details of the structure of the bolt, shown in greater detail in FIGS. 5–10 of the drawings is similar to that shown in FIGS. 10–16 of U.S. Pat. No. 3,301,123, as described in detail therein, and therefor a reiterative description in detail is not felt necessary herein. Reference is made to, and the disclosure of said aforementioned patent is incorporated herein by reference, it being noted that a common ownership is present.

The bolt 24 includes a pair of coactive elongated steel members. A body member or portion 26 is of a general U-shaped configuration having a curvilinear closed side 28, which is the rear side, and an open face at 30. It will be seen from FIGS. 6, 7 and following that the body member 26 while being of a generally U-shaped configuration has the free edges 32A, 32B thereof slightly inwardly curved and defining therebetween a distance slightly less than the diameter of the U-shaped portion of body member therebelow. The purpose of this construction will be explained hereinafter.

The free edges 32A, 32B are configured to form an undulating or stepped wavilinear configuration broadly indicated at 34, thereby creating a plurality of individual angularly disposed longitudinally spaced substantially planar first cam surfaces 36, 38 and intermediate curvilinear apexes and bases 40, 42, respectively. It will be noted that the edges are generally of a curvilinear rather than a sharply breaking configuration.

In one embodiment of the invention, the body is formed of Corten steet steel sheared in mirror configuration into body blanks 31½" long. The body blanks are formed from the flat into the rounded, substantially U-configured, elongated shapes with the aid of dies. Preferably the sharp edges of the body are smoothed with a coining die.

Figure 7:
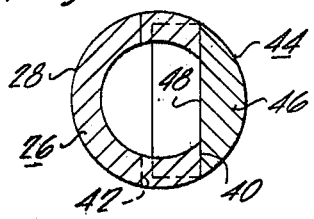
FIG. 7 is a sectional view of the bolt taken on line 7—7 of FIG. 5.
Figure 11:
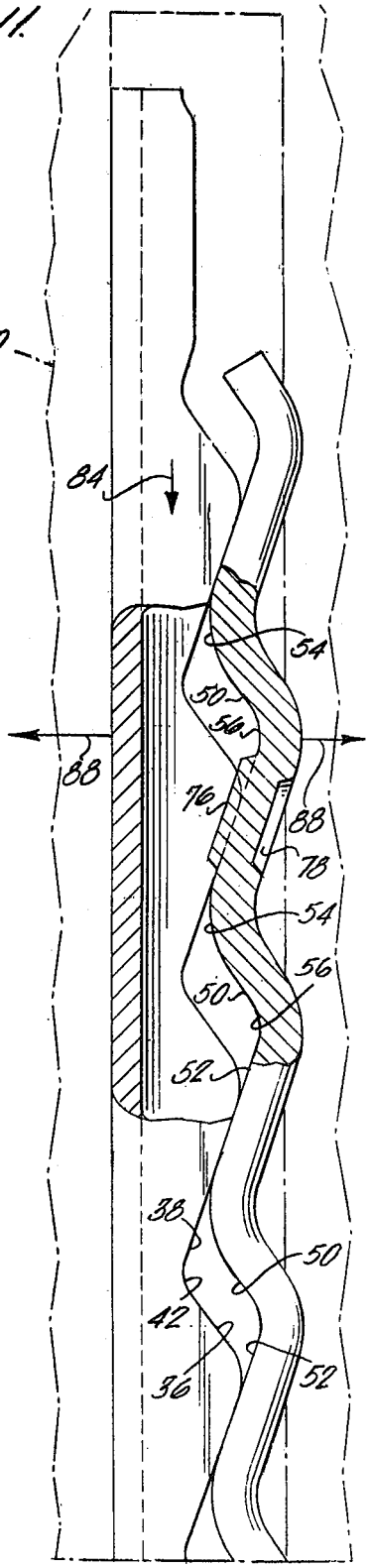
FIG. 11 is a view similar to FIG. 5 but showing the bolt subsequent to actuation to a laterally expanded condition and applying lateral force to the material of the mine roof about the hole in which inserted.

A slide member 44 formed from a partial round bar, shaped over dies, has imparted thereto a generally serpentine shape, again of a generally stepped wavilinear configuration broadly similar to that of the body edges 32A, 32B, and in cross-section is of a generally cylindrical segmental configuration as broadly shown at 46 in FIG. 7. The inner surface 48 of the slide member has a width substantially of the same dimension as the overall outer width formed by the edges 32A, 32B of body member 26, and the slide is adapted for sliding coactive movement along the edges of the body member, all as set forth in the abovementioned prior patent. The curvilinear configuration of the slide member again consists of a plurality of substantially flat spaced planar second cam surfaces 50, 52 as shown in FIG. 11 and with intermediate curvilinear apexes 54 and curvilinear bases 56. The overall mating or coacting configurations of the body member and slide member are similar, it being noted that the curvilinear bases 42 of the body member are slightly deeper than the dimension of the coacting curvilinear apex 54 of slide 44.

The slide 44 in a preferred embodiment is a specially rolled half-round shape of, for example, 1020 carbon steel which comes in pallets from a steel mill. The pallets are cut and shaped over dies into the serpentine shape as shown, and have a straight surface portion 58 at one end. It will also be noted that the lower end of the body member is provided with a straight edged portion at 60. In one preferred embodiment, a ¾" high tensile threaded stud 62, on which one end 64 is tooled down and is welded into the interior of the straight portion 60 of the body member, the welding thereinto is indicated at 66.

A ¼" high strength embossed plate approximately 6" by 6" is placed over the stud, as shown in FIG. 3 at 68, with the ridge 70 embossed therein providing for strength. A 2" hardened washer 72 and a 1¼" high tensile steel hex nut 74 are hand-tightened against plate 68 to assemble the same to the threaded stud 62. Preferably a locking ring is fastened to the end of the stud to prevent the nut from working off, or a metal stop is welded to the end of the stud for the same purpose. It is pointed out that in one embodiment the Corten sheet steel forming the body has a 60,000 minimum yield, 178 minimum gauge sheet with a width of 31⅜" and a length of 96", hot rolled, pickled and oiled. As a practical matter grease is added to the threads of the bolt prior to assembly of the plate, washer, nut, etc.

Figure 5:
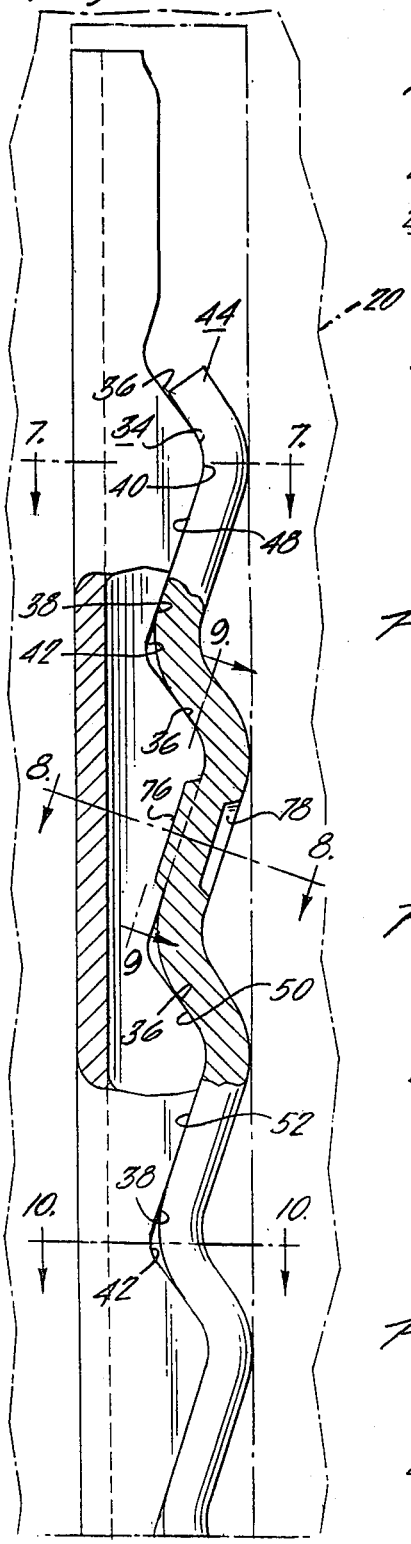
FIG. 5 is a fragmentary view, partly broken away and in section, on a mine bolt in side elevation and in a pre-assembled or nested position, inserted in a mine roof opening prior to expansion of the bolt.
Figure 6:
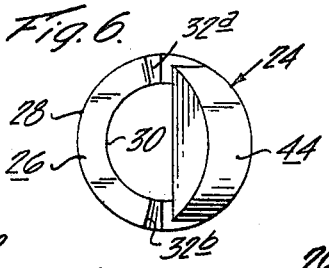
FIG. 6 is a top plan view of the bolt of FIG. 5.
Figure 8:
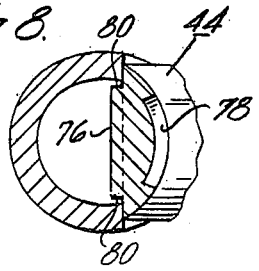
FIG. 8 is a sectional view of the bolt taken on line 8—8 of FIG. 5.
Figure 9:
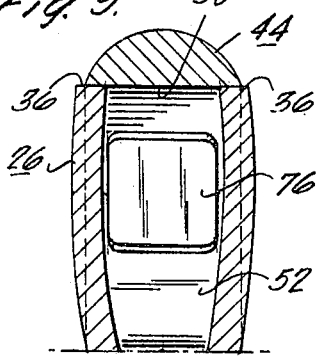
FIG. 9 is a view, partly in section, taken on line 9—9 of FIG. 5.
Figure 10:
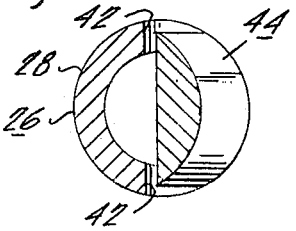
FIG. 10 is a sectional view of the bolt taken on line 10—10 of FIG. 5.

Due to the dimensions between the edges of the body member and the external dimension of the slide as pointed out above, as also the general configuration thereof, there is always a possibility that the two members can become laterally displaced with respect to one another, i.e., the slide can have one edge thereof slide or slip into the interior of the U-shaped configuration of the body member. This would destroy function of the roof bolt as will be obvious. In order to obviate this, and of the essence of the present invention, are the provision of inwardly extending protrusions 76 on the inner surface of the slide on spaced ones of the flat planar surface 50. These protrusions 76 are formed by punching of the slide member at 78 in a known manner. As shown in FIGS. 5 and 9, these protrusions 76, on the inner surface of the slide are of a generally oval shape and have tapering longitudinal ends at 78 and substantially square side edges 80. The protrusions 76 engage in a longitudinally extending channel or slot **30*a* formed betweenn the side edges 31A, 32B of the U-shaped body member 26 and are preferably of a lateral or transverse dimension D slightly less than the lateral space D, between the side edges 32A, 32B as illustrated in FIG. 8 to maintain the cooperating cam surfaces of the body and slide members in engaging contact. This configuration provides for ease of movement of the slide with respect to the body member, with the straight side edges preventing displacement upon rectilinear sliding movement between the members as indicated by arrow 82, upon actuation of the bolt to the laterally extended position shown in FIG. 11. It has been found that a protrusion or interior projection provided at spaced positions, near the upper and lower ends of slide member 44**, serve the desired end function thereof.

In practice, as also set forth in the abovementioned patent, the bolt in the nested position preferably has the body and slide joined together temporarily by means of flex tapes 82 (see FIG. 1), these tapes being solely for the function of initially assembling the two members together as a unit for insertion into the openings provided in the mine roof. Thereafter these tapes will not serve any function.

Subsequent to insertion of the bolts into the openings as generally shown in FIG. 1, and upon applying a turning torque to hex nut 74, the upper surface of plate 68, being in contact with the undersurface of the mine roof, will result in the body member 26 being downwardly moved as indicated by arrows 84, and in effect resulting in respective axial or lineal relative motion between the body member and slide. Due to the configuration of the respective mating surfaces of these two members, a lateral separating force is applied as differentially shown between FIGS. 5 and 11. The direction of lateral force application is noted by a direction of force indicator line 86 on the bottom of the stud as shown in FIG. 4. In practical application a hole or opening is formed in the roof with the dimension of $1\frac{3}{8}''$. In the collapsed or nested position of the two members of the bolt, the outside dimension thereof is 1 5/16". In the expanded position as indicated in FIG. 11 of the drawings the outside diameter is approximately 1 11/16". It has been found that when actuated as mentioned above, a lateral force, as indicated by arrows 88 in FIG. 11, is in the neighborhood of approximately 28,000 to 30,000 pounds of force. Obviously this can vary depending upon the particular dimensions.

Figure 12:
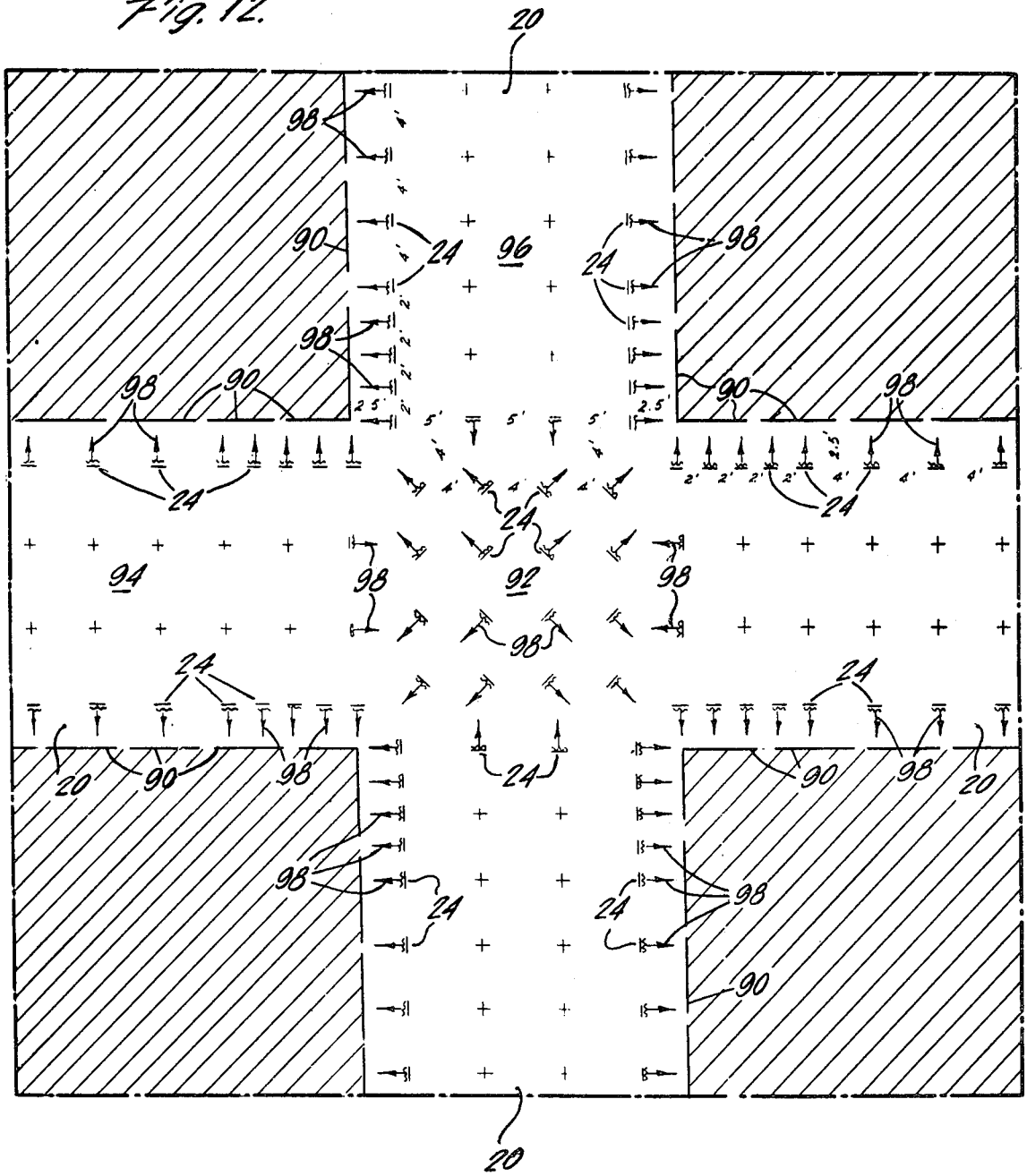
FIG. 12 is a schematic view depicting placement of mine bolts in accordance with the invention and creating a lateral force system for a mine roof in accordance with teachings of the invention.

In FIG. 12 a particular pattern of placement or system utilizing the bolts of the invention is disclosed. Ribs 90 of the pillars formed in the mine are shown with an intersection therebetween indicated at 92. Entries and cross cuts are generally indicated at 94, 96, for general illustration only.

The mine bolts of the invention are indicated at 24 with arrows of force and direction being schematically designated at 98. A particularly effective pattern has resulted from having the bolts at the intersections on four foot centers, and which expand toward the corners as shown by the arrows. At intersection corners it is preferable to form a square with the bolts, even if an extra row is necessary. The middle bolts expand as shown by the arrows, parallel to entry, and the rib bolts expand toward the ribs.

At entries and cross cuts the bolts are placed 2.5 feet from the ribs, 5 feet between bolts in the middle of entries and cross cuts. The bolts are placed with 4 feet between the rows, except starting 8 feet from intersection, to the intersection, rib bolts are 2 feet between rows. The rib bolts expand towards the rib. The middle bolts expand randomly.

The foregoing result occurs when the bolts are expanded by tightening with the nuts and the end result is that the bolts, when so inserted and activated, support coal mine roofs by placing the roof rock in sufficient compression through the application of lateral force to prevent the weak laminated shale, for example, from sagging or moving. The bolt exerts a pair of forces in opposite directions and the extent of the force will of course vary depending upon the material of the strata as also possible deformation of the bolt in the hole as it is tightened. Rather than a random or haphazard installation of bolts, with random direction of force, orienting of the bolts so that they expand with the forces perpendicular to the wall reduce the possibility of shearing action in planes parallel to the plane of the face of a pillar or rib, for example. The bolts being oriented to exert forces perpendicular to the walls contribute compressive stress at vertical shear planes, and thus serve to lessen a tendency for shear failure at these planes.

Otherwise as generally pointed out, the pattern and system of installation has been found to be highly effective and efficient in use. The position and orientation of the various bolts in conjunction with the surfaces are of substantial significance, as also are the utilization of greater or lesser spacings in various regions and placements of the bolts, as can be appreciated. The overall end result is a highly satisfactory roof reinforcement for mines.

The structure, system, function and advantages of the present invention will be readily understandable from the foregoing description of a preferred embodiment when taken together with the drawings.

Many other possible variations in specifics of components or details of the invention will be apparent to those skilled in the art. While in the present disclosure, there are shown preferred embodiments of the invention, it is to be understood that the invention is capable of changes or modifications without departing from the spirit and the scope of the inventive concept as expressed herein.

What is claimed is:

1. A mine roof bolt adapted for insertion in a vertical hole in a said roof, said bolt comprising a U-shaped body member with laterally spaced front edges, said front edges having a stepped curvilinear configuration defining first cam surfaces, a slide member coactive with said body member and having a similar mateable stepped curvilinear configuration defining second cam surfaces, said members being coactive upon relative opposite rectilinear displacement of said mating stepped cam surfaces from low to high portion contact thereof to laterally space said members and create lateral oppositely directed forces against contacted side portions of the hole, and protrusion means on said slide member extending into, and coacting with the interior of said U-shaped body member to prevent substantial lateral movement therebetween and maintain said cam surfaces in confronting contacting engagement.

2. A mine roof bolt adapted for insertion in a vertical hole in a said roof, said bolt comprising a generally open interior U-shaped body member having a curved rear surface and extended laterally spaced free front edges, said free front edges being of longitudinally extending stepped curvilinear configuration defining a plurality of stepped longitudinally spaced first cam surfaces, a slide member having a longitudinally extending stepped curvilinear configuration generally similar to that of said free front edges of said body member and defining a plurality of stepped longitudinally spaced second cam surfaces confronting and engageable with said first cam surfaces, said members being coactive upon relative rectilinear movement and moving interengagement of said cam stepped surfaces from low to high portions thereof to laterally space said members and thereby create lateral directed forces against contacted portions of the hole by the expanded bolt members, and protrusion means on said slide member extending into the open interior of said body member and operable to prevent substantial lateral movement therebetween and maintain said cam surfaces in confronting contacting engagement.

3. A mine roof bolt as claimed in claim 1, said protrusion means comprising plural protrusions positioned at longitudinally spaced points of said slide member, operable to serve as longitudinal restrictive guide movement means during the relative rectilinear displacement of said members.

4. A mine roof bolt as claimed in claim 3, said protrusions being constituted by punchings of the slide material from the side opposite from said protrusions.

5. A mine roof bolt as claimed in claim 4, said protrusions having substantially erect straight longitudinal side faces adapted for mating and sliding contact with the internal longitudinal faces of said U-shaped body member proximate said front edges.

6. A mine roof bolt as claimed in claim 5, the longitudinal ends of said protrusions being sloped downwardly from a central area of greatest height and substantially merging in the slide member surface.

7. A mine roof bolt as claimed in claim 6, said plural protrusions being positioned proximate the ends of said slide member.

8. A mine roof bolt as claimed in claim 7, including means operatively attached to said body member and said slide member whereby, subsequent to insertion in a said vertical hole in a said roof, said body member can be downwardly vertically displaced with respect to said slide member to thereby respectively move the mating configured stepped surfaces to cause the lateral spacing therebetween.

9. A mine roof bolt as claimed in claim 8, including visual indicator means on said lateral spacing means to indicate the direction of resultant lateral force.

10. A mine roof bolt as claimed in claim 1 wherein said body member is formed with an elongated open channel or slot and wherein said protrusion projects into said channel and is of a lateral dimension slightly less than the width of the lateral width of the channel adjacent the laterally spaced front edges thereof.

* * * * *